US006572516B2

(12) United States Patent
Clarke et al.

(10) Patent No.: US 6,572,516 B2
(45) Date of Patent: Jun. 3, 2003

(54) DEVICE TO REDUCE ELECTROSTATIC PATTERN TRANSFER IN COATING PROCESSES

(75) Inventors: Andrew Clarke, Berkhamstead (GB); Terry Blake, Tring (GB)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/071,315

(22) Filed: Feb. 8, 2002

(65) Prior Publication Data

US 2002/0072458 A1 Jun. 13, 2002

Related U.S. Application Data

(63) Continuation of application No. 09/464,428, filed on Dec. 16, 1999, now abandoned.

(30) Foreign Application Priority Data

Dec. 23, 1998 (GB) ..... 9828305

(51) Int. Cl.[7] ..... B23P 15/00
(52) U.S. Cl. ..... 492/30; 492/54
(58) Field of Search ..... 492/30, 31, 33, 492/34, 35, 36, 37, 54, 58; 118/621, 624; 427/458

(56) References Cited

U.S. PATENT DOCUMENTS

| | | | | |
|---|---|---|---|---|
| 3,335,026 A | | 8/1967 | DeGreest et al. | |
| 3,405,855 A | | 10/1968 | Daly et al. | |
| 3,599,306 A | * | 8/1971 | Brafford | 492/30 |
| 4,353,296 A | * | 10/1982 | Beucker | 100/121 |
| 4,426,757 A | | 1/1984 | Hourticolon et al. | |
| 4,427,166 A | | 1/1984 | Oishi et al. | |
| 4,835,004 A | | 5/1989 | Kawanishi | |
| 4,837,045 A | | 6/1989 | Nakajima | |
| 4,864,460 A | | 9/1989 | Muramatsu et al. | |
| 4,879,791 A | * | 11/1989 | Herb | 29/895.32 |
| 4,960,050 A | * | 10/1990 | Hatch | 101/348 |
| 5,122,386 A | | 6/1992 | Yoshida | |
| 5,191,703 A | * | 3/1993 | John | 29/895.32 |
| 5,295,039 A | | 3/1994 | Nakajima et al. | |
| 5,387,966 A | | 2/1995 | Karashima | |
| 5,431,321 A | | 7/1995 | Link et al. | |
| 5,609,923 A | | 3/1997 | Clarke | |

FOREIGN PATENT DOCUMENTS

| | | |
|---|---|---|
| EP | 0 390 774 | 7/1992 |
| EP | 0 530 752 | 3/1993 |
| WO | 89/05477 | 6/1989 |

* cited by examiner

*Primary Examiner*—I Cuba Rosenbaum
(74) *Attorney, Agent, or Firm*—Frank Pincelli

(57) ABSTRACT

A roller for use in a coating machine comprises a metal core 1 having a dielectric cover 2. The cover is provided with an engraved pattern of ridges and grooves. The core is also provided with a pattern in register with the pattern in the cover such that an electrostatic field generated above a web supported on the roller may be made substantially uniform.

8 Claims, 3 Drawing Sheets

DEVICE TO REDUCE ELECTROSTATIC PATTERN TRANSFER IN COATING PROCESSES

CROSS REFERENCE TO RELATED APPLICATIONS

This is a Continuation of application Ser. No. 09/464,428, filed Dec. 16, 1999, entitled "Device To Reduce Electrostatic Pattern Transfer In Coating Processes" by Andrew Clarke and Terry Blake, now abandoned.

FIELD OF THE INVENTION

The invention relates to rollers used in a coating apparatus. In particular the invention relates to apparatus used for coating one or more viscous coating compositions as a composite layer onto a continuously moving receiving surface, such as in the manufacture of photographic films, photographic papers, magnetic recording tapes or such like.

BACKGROUND OF THE INVENTION

In an apparatus designed for the production of coated webs of material, the web is conveyed through the machine by a series of rollers. As the web moves through the machine, the web entrains a layer of air termed a boundary layer. At each roller, as the web approaches, the boundary layer on the web face about to contact the roller is squeezed between the web and the roller. The increased pressure causes the web to lift off the roller, thereby causing a loss of traction and poor web steering. It is well known in the art that this problem is alleviated by forming a pattern in the roller surface such that the boundary layer of air can escape, thereby recovering good traction and conveyance. The pattern may take several forms: a random pattern (U.S. Pat. No. 4,426,757), a roller wound with spaced turnings of wire (U.S. Pat. No. 5,431,321; U.S. Pat. No. 4,427,166) or a groove pattern (U.S. Pat. No. 3,405,855).

Throughout the coating machine, individual rollers may be patterned differently, however a simple and well-known pattern that is often used is the groove pattern. This consists of a periodic series of grooves cut around the circumference of the roller where the period, depth and width of the grooves is determined by the requirements for speed of conveyance and by the web material that is being conveyed (U.S. Pat. No. 3,405,855). This groove pattern is easy to manufacture and is easy to clean should debris contaminate the grooves, and thus is particularly favoured.

It is well known in the art of coating that to improve the maximum obtainable coating speed before the onset of air entrainment, an electrostatic field may be applied at the coating point (for example, EP 390774; WO 89/05477; U.S. Pat. No. 5,609,923). In general, the web is supported by a roller at the coating point and this roller is referred to as the coating roller. It is also well known that the electrostatic field may be generated by either providing a charge on the web surfaces and grounding both the coating roller and the coating liquid (for example, EP 390774; U.S. Pat. Nos. 4,835,004; 5,122,386; 5,295,039; EP 0 530 752 A1), or by biasing the coating roller while maintaining the liquid at ground potential (for example, U.S. Pat. Nos. 3,335,026; 4,837,045; 4,864,460), or by a combination of both. In either case, a particular coating defect may arise whereby the roller pattern is transferred to the final coating (see U.S. Pat. No. 5,609,923 and U.S. patent application Ser. No. 09/212,462; filed Dec. 16, 1998 by Mark C. Zaretsky et al; entitled METHOD FOR USING A PATTERNED BACKING ROLLER FOR CURTAIN COATING A LIQUID COMPOSITION TO A WEB. This defect is herein described as electrostatic pattern transfer, however, for a grooved roller this defect is sometimes known as microgroove lines. It will be understood that the defect results in unusable product and therefore must be avoided. On certain web materials and under certain conditions therefore, an electrostatic field cannot be used to enhance coating speeds, and the coating machine must be run more slowly, so reducing productivity.

SUMMARY OF THE INVENTION

According to the present invention there is provided a roller for use in a coating machine, the roller comprising a metal core having an outer cover of dielectric material, the cover being provided with an engraved pattern, the core being provided with a second pattern having ridges under the engraved pattern in said cover and in register with the pattern in said cover, whereby an electrostatic field generated above a web supported on the roller may be made substantially uniform.

The roller design alleviates the problem of electrostatic pattern transfer, thereby expanding the applicability of electrostatic fields in the coating process.

The combination of the pattern cut in the dielectric cover and the pattern formed on the core is such that when a voltage is applied to the roller, or when a charge is applied to the web being coated, the field in the immediate vicinity of an earthed plane immediately above is substantially constant. Where the earthed plane is a liquid being coated onto the web, the fact that the field is substantially constant significantly reduces the electrostatic pattern transfer defect. In addition, the pattern cut in the dielectric cover acts in the usual way to provide an escape path for the boundary layer air carried along by the web.

For a better understanding of the present invention reference is made to the following drawings and detailed description.

DETAILED DESCRIPTION OF THE INVENTION

Figure 1A:
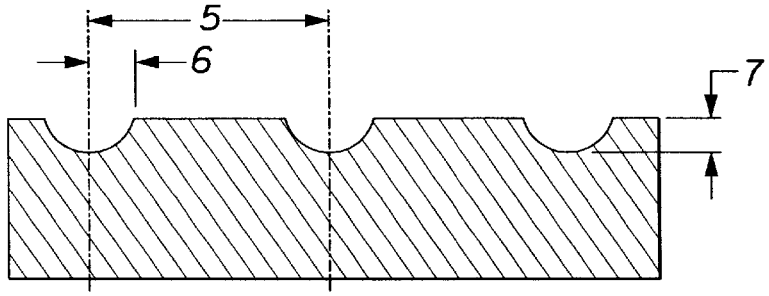
FIG. 1*a* is a schematic cross-sectional view, parallel to the roller axis, of the surface of a conventional roller.

FIG. 1 shows a cross-section of a conventional roller. Although the grooves shown are of circular section, alternative shapes, for example, rectangular, may be used.

Figure 2:
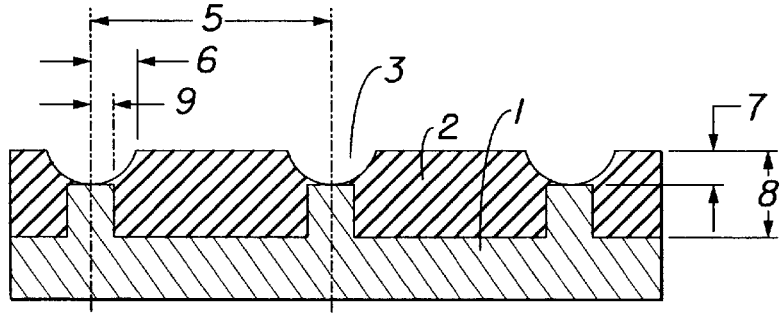
FIG. 2 is a schematic cross-sectional view, parallel to the roller axis, of the surface of a roller according to the invention.
Figure 3:
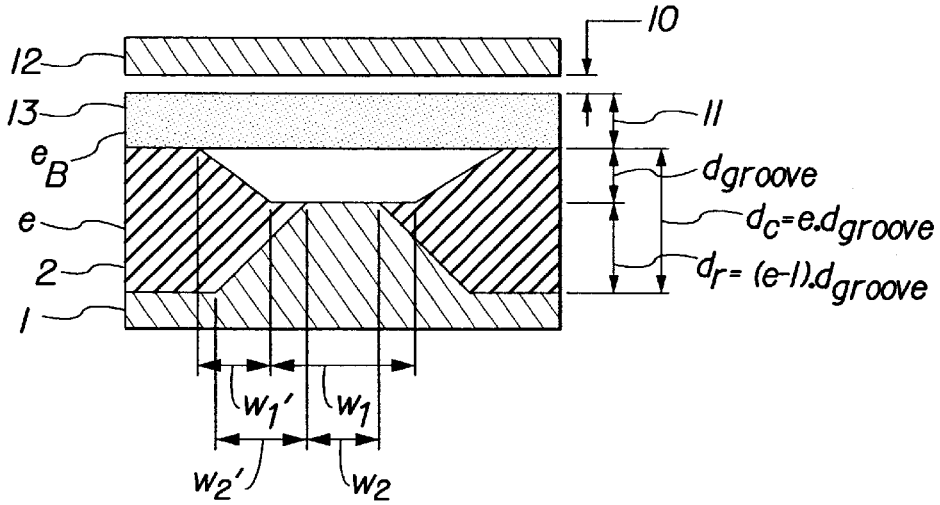
FIG. 3 shows an electrode configuration that may be used for the purposes of optimising the design of a pattern.
Figure 1B:
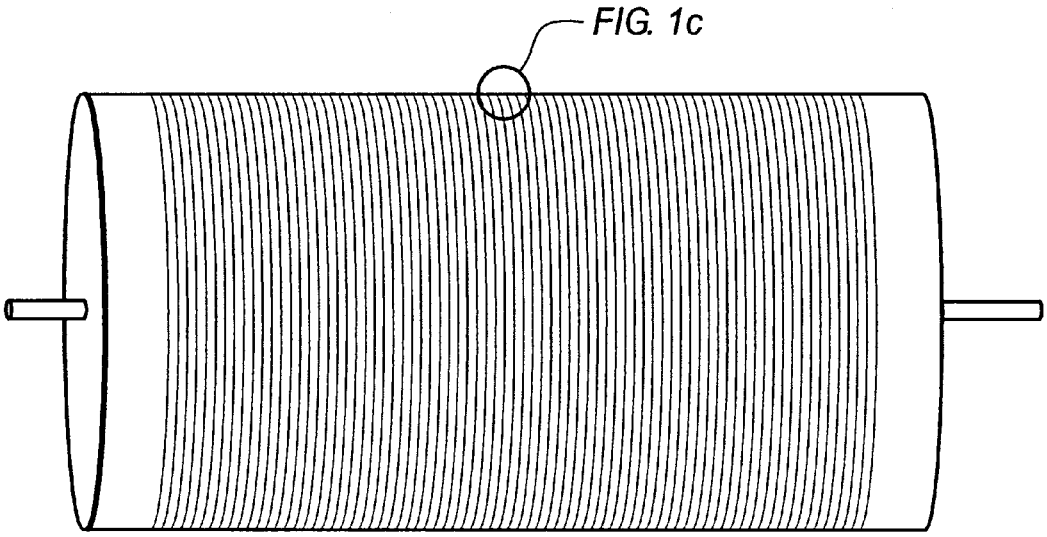
FIG. 1*b* is a perspective view of the roller of FIG. 1*a;*
Figure 1C:
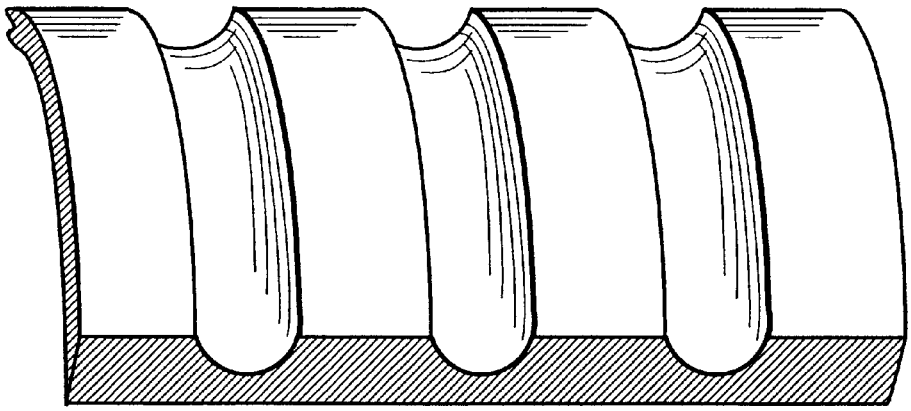
FIG. 1*c* is a greatly enlarged section of the roller of FIG. 1*b* as indicated by circle 1*c;*

Referring to FIG. 2, a metal core 1 is covered by a layer of dielectric material 2. It will be understood that material of layer 2 should be chosen such that it has the appropriate properties for a coating roller: hardness, durability, machinability, stability, etc. In addition and for convenience, material 2 should have as low a relative permittivity as possible consistent with the other material property requirements. A pattern 3, which may be grooves, is cut in the dielectric layer. For a grooved roller, dimension 5 is the groove period, 6 is the half-width of the groove and 7 is the depth of the groove. These dimensions are the same as for the conventional roller shown in FIG. 1 and are determined by the requirement for good ventilation between the web and the roller. Good ventilation allows good traction and conveyance. For the core 1 of the grooved roller, dimension 5 is also the period of the pattern on the core, 9 is the half width of the metal ridges and 8 is the depth of the dielectric layer. The depth 8 should be approximately equal to the relative permittivity of the layer multiplied by the dimension 7. It should be noted that the patterns used for the roller and core shown in FIGS. 1*b*, 1*c* and 2 are not unique and other patterns following the same general principles will also work. However, having chosen the pattern dimensions and shape for engraving the dielectric layer, the dimensions and pattern of the metal core will have optimum values. The required pattern for the metal core may be optimised by calculating the field strength variation at the surface of electrode of the model configuration illustrated in FIG. 3. FIG. 3 shows an electrode 12 separated by distance 10 from a web 13 of thickness 11 and relative permittivity $e_B$. The dielectric roller cover 2 of relative permittivity e, has a groove of generalised shape cut in it (dimensions: $d_{groove}$, $d_c=e.d_{groove}$, $w_1'$, and $w_1$) and is backed by the metal core 1, again of generalised shape (dimensions: $d_r=(e-1).d_{groove}$, $w_2'$, and $w_2$). Such a calculation may be performed using one of several standard numerical techniques, for example, finite difference, finite element, etc. The shape of the groove and ridge in FIG. 3 can of course be further generalised and FIG. 3 should not be regarded as limiting the invention.

In applying this invention, since a dielectric web will necessarily be contacting a dielectric surface (the roller) there is the possibility that the surface of the roller will become charged. This possibility can be minimized by the use of ionizers, etc. Alternatively, the surface of the roller could be made very weakly conductive so as to bleed the charge away.

EXAMPLE

Figure 4:
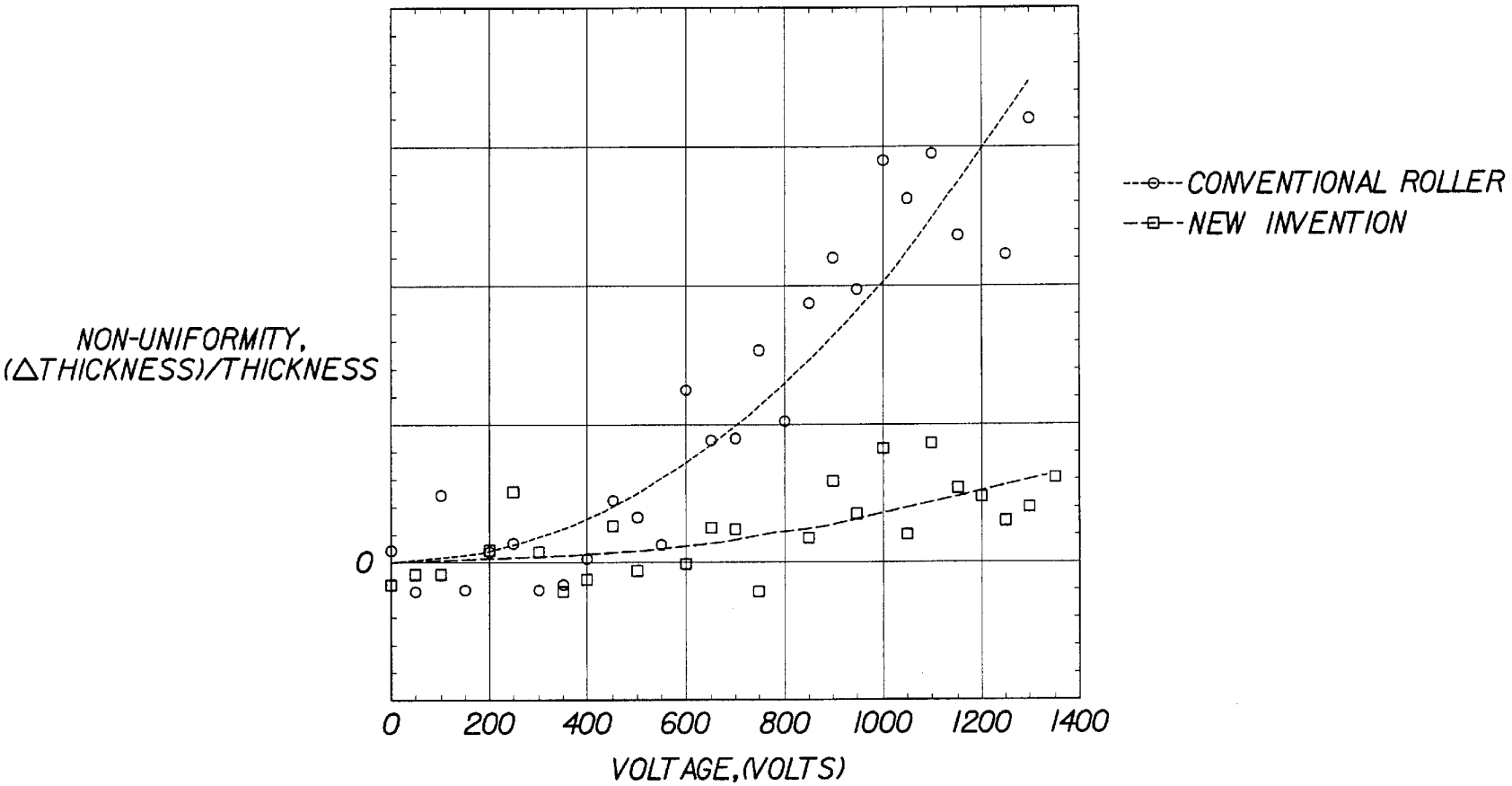
FIG. 4 is a graph showing coating non-uniformity against voltage applied to the coating roller for both a roller according to the invention and a conventional roller.

The new design has been tested in a coating roller and the effect on the coating non-uniformity assessed. The roller was constructed to have grooves of conventional design on one half and of the new design on the other. In this way, direct comparison of the efficacy of the design for otherwise identical coating conditions could be made. FIG. 4 shows the relationship between the severity of the non-uniformity seen in the coating and the voltage applied to the coating roller. The line joining the circles represents a roller having a conventional surface as shown in FIG. 1, and the line joining the squares represents the new surface having the composite structure as shown in FIG. 2.

In the experiment, a two-layer coating was made. The total flow rate of liquid per unit width was 1.22 $cm^2/s$ and the web speed was 75 $cm^2/s$. The coating liquids were aqueous gelatine having a top layer low-shear viscosity of 65 mPas, a bottom layer low-shear viscosity of 120 mPas, and a bottom layer flow rate per unit width of 0.17 $cm^2/s$. In addition, the bottom layer contained blue dye to enable measurement of the severity of the non-uniformity. The substrate was polyethylene teraphthalate precoated with a gelatine subbing layer. The dimensions of the microgrooves were 5=1.2 mm, 6=0.2 mm, 9=0.1 mm, 7=0.15 mm and 8=0.4 mm. These dimensions are approximate and were not fully optimised. The dielectric layer was made from an epoxy resin (RS Components stock number 199-1402) with relative permittivity e=2.69. It will be understood that the absolute magnitude of the coating non-uniformity will depend on the coating method used and the conditions employed. However, the relative magnitude of the non-uniformity between the conventional surface and the new surface of composite structure is dependent only on the roller design. It is clear from the results shown in FIG. 4 that the new surface design for the dimensions specified shows an approximately six-fold improvement over the conventional surface.

Parts List

1. Metal core
2. Dielectric cover
3. Engraved pattern on cover
4. Engraved pattern on core
5. Groove period
6. Half width of groove
7. Depth of groove
8. Depth of dielectric layer
9. Half width of metal ridges
10. Distance between electrode and web
11. Web thickness
12. Electrode

What is claimed is:

1. A support roller for use in a coating machine, the roller comprising a metal core having an outer cover of dielectric material, the cover having an outer surface into which an engraved pattern has been cut, the core being provided with a second pattern having ridges under the engraved pattern in said cover such that the ridges are in register with the cuts of the engraved pattern and lie directly below said cuts in the engraved pattern in said cover, the maximum thickness of said dielectric cover being substantially equal to the depth of said engraved pattern in said cover multiplied by the relative permittivity of the cover, the registry of the engraved pattern in the cover and the second pattern in the core being such that when an electrostatic field generated between a coating liquid and a web supported on the roller is calculated to be substantially uniform at a liquid surface, a resulting coating is substantially free of electrostatically induced defects.

2. A roller as claimed in claim 1 wherein said dielectric cover is bonded to said metal core.

3. A roller as claimed in claim 1 wherein said engraved pattern comprises continuous channels cut around the circumference of the roller.

4. A roller as claimed in claim 1 wherein the relative permittivity of said dielectric cover is between approximately 2 and 10.

5. A roller as claimed in claim 1 wherein said roller is a coating roller.

6. A roller as claimed in claim 1 wherein said dielectric material comprises a ceramic.

7. A roller as claimed in claim 1 whereon said dielectric material comprises an epoxy resin.

8. A roller as claimed in claim 1 wherein said dielectric material comprises a polymer.

* * * * *